US010100478B2

(12) United States Patent
Fuhrmann

(10) Patent No.: US 10,100,478 B2
(45) Date of Patent: Oct. 16, 2018

(54) DEVICE FOR SECURING FLOATING BODIES

(71) Applicant: DUAL DOCKER GmbH, Munderfing (AT)

(72) Inventor: Michael Fuhrmann, Munderfing (AT)

(73) Assignee: Dual Docker GmbH, Munderfing (AT)

( * ) Notice: Subject to any disclaimer, the term of this patent is extended or adjusted under 35 U.S.C. 154(b) by 0 days.

(21) Appl. No.: 15/525,734

(22) PCT Filed: Nov. 11, 2015

(86) PCT No.: PCT/AT2015/050289
§ 371 (c)(1),
(2) Date: May 10, 2017

(87) PCT Pub. No.: WO2016/074012
PCT Pub. Date: May 19, 2016

(65) Prior Publication Data

US 2017/0350083 A1 Dec. 7, 2017

(30) Foreign Application Priority Data

Nov. 14, 2014 (AT) ..... A 50833/2014

(51) Int. Cl.
*E02B 3/24* (2006.01)
*B63B 21/00* (2006.01)
*B63B 21/50* (2006.01)

(52) U.S. Cl.
CPC ..... *E02B 3/24* (2013.01); *B63B 21/00* (2013.01); *B63B 21/50* (2013.01); *B63B 2021/501* (2013.01)

(58) Field of Classification Search
CPC ..... E02B 3/24; B63B 21/00; B63B 21/50; B63B 35/44; B63B 2035/442
USPC ..... 405/196, 200, 224; 114/230.13, 230.14
See application file for complete search history.

(56) References Cited

U.S. PATENT DOCUMENTS 3,668,875 A * 6/1972 Sander ..... B63B 22/021 114/230.14
4,417,646 A * 11/1983 Lindbergh ..... F16F 15/28 187/405
4,493,282 A * 1/1985 Ortloff ..... B63B 27/24 114/230.14

(Continued)

FOREIGN PATENT DOCUMENTS

FR 2 396 126 1/1979
GB 2 002 048 A 2/1979

(Continued)

OTHER PUBLICATIONS

Espacenet. English language abstract of WO2016/074012(A1), Michael Fuhrmann, May 19, 2016.

(Continued)

*Primary Examiner* — Frederick L Lagman
(74) *Attorney, Agent, or Firm* — Tiajoloff & Kelly LLP

(57) ABSTRACT

The invention relates to a device for fixing floating bodies (1, 1') with a pile (2) which can be fixed at one end to a ground (G) and in the region of the other end of which the floating body (1, 1') can be fixed. For the purpose of providing advantageous fixing conditions, it is proposed that the pile (2) is designed as a telescopic tube (3).

18 Claims, 5 Drawing Sheets

(56) References Cited

U.S. PATENT DOCUMENTS

| | | | | |
|---|---|---|---|---|
| 4,493,283 | A * | 1/1985 | Elliott | B63B 22/02 114/230.13 |
| 4,543,014 | A * | 9/1985 | Brandi | B63B 22/021 114/230.13 |
| 4,597,350 | A * | 7/1986 | Mott | B63B 22/021 114/230.13 |
| 4,721,053 | A * | 1/1988 | Brewerton | B63B 21/50 114/230.13 |
| 4,726,313 | A * | 2/1988 | Neal | E02B 3/26 114/230.1 |
| 5,307,753 | A * | 5/1994 | Besonen, Sr. | B63B 21/20 114/230.18 |
| 5,347,949 | A * | 9/1994 | Winston | B63B 35/44 114/264 |
| 8,109,222 | B2 | 2/2012 | Fuhrmann | |
| 2008/0314304 | A1* | 12/2008 | Jayne | B63B 21/00 114/230.17 |
| 2011/0107952 | A1* | 5/2011 | Nicholson, IV | B63B 21/26 114/230.13 |
| 2012/0282034 | A1* | 11/2012 | del Campo y Ruiz de Almodoyar | G01W 1/08 405/200 |

FOREIGN PATENT DOCUMENTS

| | | | |
|---|---|---|---|
| GB | 2 069 954 | A | 9/1981 |
| JP | H07-101382 | A | 4/1995 |
| NL | 8600973 | A | 11/1987 |
| WO | 2009015403 | A1 | 2/2009 |
| WO | 2014110610 | A1 | 7/2014 |

OTHER PUBLICATIONS

Espacenet. English language abstract of WO2014/110610(A1), Michael Fuhrmann, Jul. 24, 2014.

Espacenet. English language abstract of JPH07-101382, Zeni Lite Buoy Co., Ltd., Apr. 18, 1995.

Espacenet. English language abstract of NL8600973(A), Swarttouw, Frans BV, Nov. 16, 1987.

* cited by examiner

DEVICE FOR SECURING FLOATING BODIES

FIELD OF THE INVENTION

The invention relates to a device for securing floating bodies with a pile which can be fixed at one end to a ground, in the region of the other end of which the floating body is provided.

DESCRIPTION OF THE PRIOR ART

Such devices are used for fixing floating bodies of any kind, in particular of floating jetties, boats, ships and the like. Floating jetties are constructions floating on the water, on which, for example, any floating bodies such as ships, boats, sports equipment and the like can be immobilized. Floating jetties are used in waterways with a tidal range as berths that are independent of the water level and in harbours to create, among other things, as many berths as possible in a confined space. The buoyancy bodies, of which usually several are provided in order to avoid the loss of the whole floating jetty in the event of a loss of one or a few buoyancy bodies, can be made of any suitable material such as steel, aluminium, concrete or plastic.

In order to prevent the floating jetties from drifting off, they are held at the desired position by means of the piles, also called pilots, which are fixed to the ground. Floating jetties are used in tidal waters as a berth that is independent of the water level. They are used to divide the water surface in sports marinas and to use it for as many berths as possible. For this purpose, the piles are usually drilled deep into the ground by means of rams and have to protrude correspondingly high above the floating body in the case of low water in order to be able to hold it securely even during high water. It is especially disadvantageous that the piles can protrude to a very high extent from the water, that the piles are unable to dampen vibrations of the floating body, and that the piles must always be guided with respective play in the tidal range in accordance with the construction, which can result in the loosening of the pile under high kinetic energy acting upon the structure due to heave of the sea, wind and the like.

The fixing of floating bodies of all types, in particular of further leading jetties, ships, boats, sports equipment or the like, is usually effected by mooring the respective floating body on the floating jetty, wherein a floating body is usually applied either longitudinally or transversely to the floating jetty. However, it is disadvantageous in respect of this prior art that, in particular in the case of adverse conditions, the floating jetty lies in a restless manner in the water and carries out considerable self-movements in the course of the wave movements, in particular various bends and twisting, which means excessive loads on all involved components such as the floating jetty, the attached floating bodies and the mooring means.

Furthermore, it is known to fasten floating bodies by means of mooring arms to jetties, harbour walls or the like (WO 2009 015403 A1), wherein the mooring arms are fixed, in particular at least at one end, around an at least approximately vertical axis with a fitting in a rotationally fixed or rotationally resilient manner to the respective mooring. The distance of the floating body from the landing body is fixed with the two mooring arms, wherein a drift of the floating body to the side and obliquely rearwards in the direction of the landing body is prevented by a rotationally fixed or rotationally spring-mounted fastening of the fittings to one end of the mooring arms and/or by clamping the mooring arms with mooring lines. In this manner, wave and wind forces acting on the floating body are introduced directly into the landing body via the mooring arms. In this way, forces acting on the floating body, in particular in the case of higher wind forces and swells, can already be cushioned and absorbed right from the start, which means that a substantially lower load on the floating body and landing element is provided.

SUMMARY OF THE INVENTION

On the basis of a prior art of the type described above, the invention is based on the object of providing a device for fixing floating bodies which avoids the aforementioned disadvantages and which is sufficiently robust with a construction which is as simple as possible and permits secure fixing of floating bodies even under adverse conditions, in particular in the case of wind and waves, and does not excessively protrude above the surface of the water.

This object is achieved by the invention in such a way that the pile is constructed as a telescopic tube, wherein the pile is designed in such a way that the pile length adapts automatically to the tidal range conditions.

As a result of the pile being designed as a telescopic tube and being fixable at one end to the ground and at the other end facing away from the ground with a floating body, the pile length easily adapts automatically to the respective tidal range conditions, i.e. the water level conditions. The pile thus follows the water level with regard to its length. The floating body floats on the surface of the water without the pile protruding excessively above a surface of the water, causing the pile to move into the required telescopic position. The piles need not protrude excessively, and optionally not at all, above the water surface. In the case of a corresponding design of the telescopic guide, practically no play between the floating body, the pile and the ground is necessary or present, which prevents the pile from breaking through the waves under adverse wind and wave conditions. Floating bodies, such as floating jetties, mooring buoys for boats or floating bodies in general, can thus be kept virtually invisible in an ideal position without having to accept large lateral drifts.

The virtually play-free guidance substantially increases durability and considerably reduces maintenance costs.

In particular, it may be provided that the pile is equipped, at its end remote from the ground, with a floating body which is fastened directly to the pile. This floating body can especially be of any desired nature. For example, reference may be made to floating jetties, buoys for fixing boats or the like.

In order to be able to keep the forces as low as possible which act on the device and are caused by wind and waves, it is provided according to a further development of the invention that the pile which is telescopic along the pile axis can be equipped with a vibration damper damping the telescopic movement. Said vibration damper functions in an equivalent manner as a vibration damper in a motor vehicle, wherein the damping material is either a mechanically elastically deformable damping mass such as polyurethane for example, a damping oil or gas which is guided in a closed circuit, or sea water which penetrates the interior of the pile via respective throttling openings.

According to a particularly advantageous further development of the invention, the pile can be equipped with a lifting force support acting in its extension direction. This means, in particular, that the floating body assigned to the pile end does not have to apply the entire force for pulling out the telescopic tube, but can be supported by the lifting force support. Said lifting force support can, for example, comprise a counterweight which can be displaced inside the pile and acts on a partial tube of the telescopic tube by means of a pulling means which is deflected by means of a deflection roller. In addition, or alternatively for this purpose, the lifting force support can comprise a spring provided in the pile interior, possibly a gas pressure spring.

In order to fix the pile in the ground, it is advisable to force the pile, which is preferably pointed at the base, into the ground. For this purpose, the pile is driven into the ground by means of respective rams, impact devices or the like. In addition or alternatively, the pile could in principle be fixed on the base side to the ground by means of at least one flange. In particular, in the case of hard, rocky grounds or when fixed to concrete troughs or the like, the piles are preferably screwed to the ground by means of the flanges and corresponding dowels.

In order to prevent excessive loads on the telescopic tube with transverse forces during strong winds and swells, it is advantageous if the pile is equipped with a ball coupling and/or a universal joint at least at one end, optionally at both ends. In the case of ball heads, inclinations of up to about 35° can be realized from a central position. Universal joints allow up to 90°.

In order to anchor the pile in an especially secure manner or to securely fix the pile even in the case of particularly adverse ground conditions, it may be advantageous if the pile is braced by means of a pulling means and/or pendulum supports which engage on the pile at one end and on the ground at the other end. Pulling means can be ropes, chains or the like, but also, in particular, a corresponding damping tether having respective own damping. The pendulum supports consist, for example, of pendulum supports which are fixed to the pile at one end and at the other end by means of fittings and which consist of two telescopically displaceable support parts which can be moved towards each other by a spring device, both in the tensioning direction as well as in the pressure direction, i.e. they are capable of removing tensile and pressure forces in a spring-loaded and optionally dampened manner. The spring device can, for example, be fitted with stop members distributed distantly in the longitudinal direction of the support and with elastomeric spring bodies provided between the stop members, wherein the stop members engage beyond the spring bodies with stop shoulders which protrude in the longitudinal direction of the supports and leave a receiving space, the volume of which at least corresponds to the displacement volume of the elastomeric spring bodies in the abutting position of the stop members. As viewed in a projection onto the pile cross-section, one, two, three, four or more pulling means and/or pendulum supports can be arranged in order to stabilize the pile, in particular distributed equally around the pile.

BRIEF DESCRIPTION OF THE DRAWINGS

The subject matter of the invention is illustrated by way of example in the drawings, wherein.

DESCRIPTION OF THE PREFERRED EMBODIMENT

Figure 1:
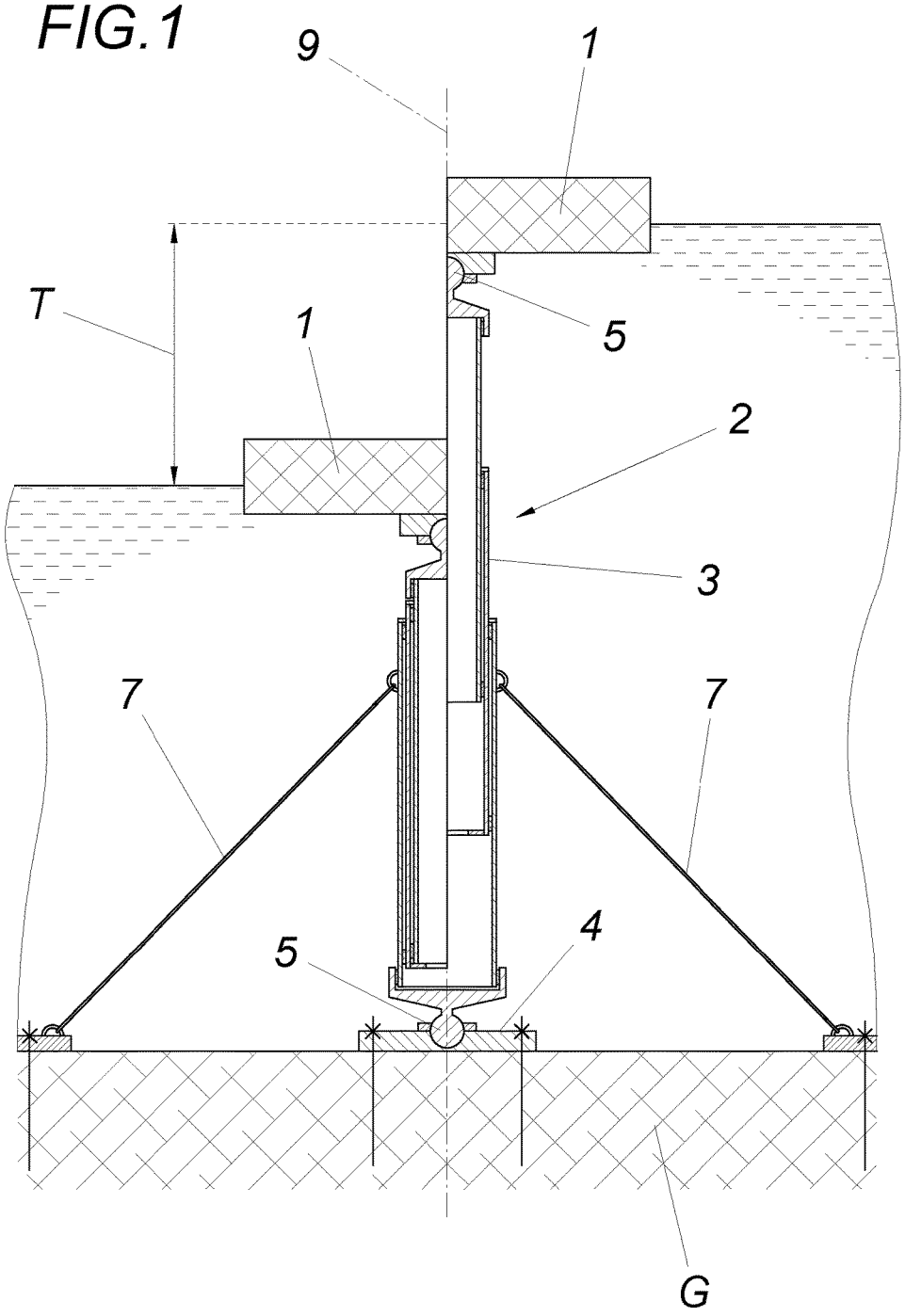
FIG. 1 shows a device according to the invention in cross-section with the representation of two stroke positions.
Figure 2:
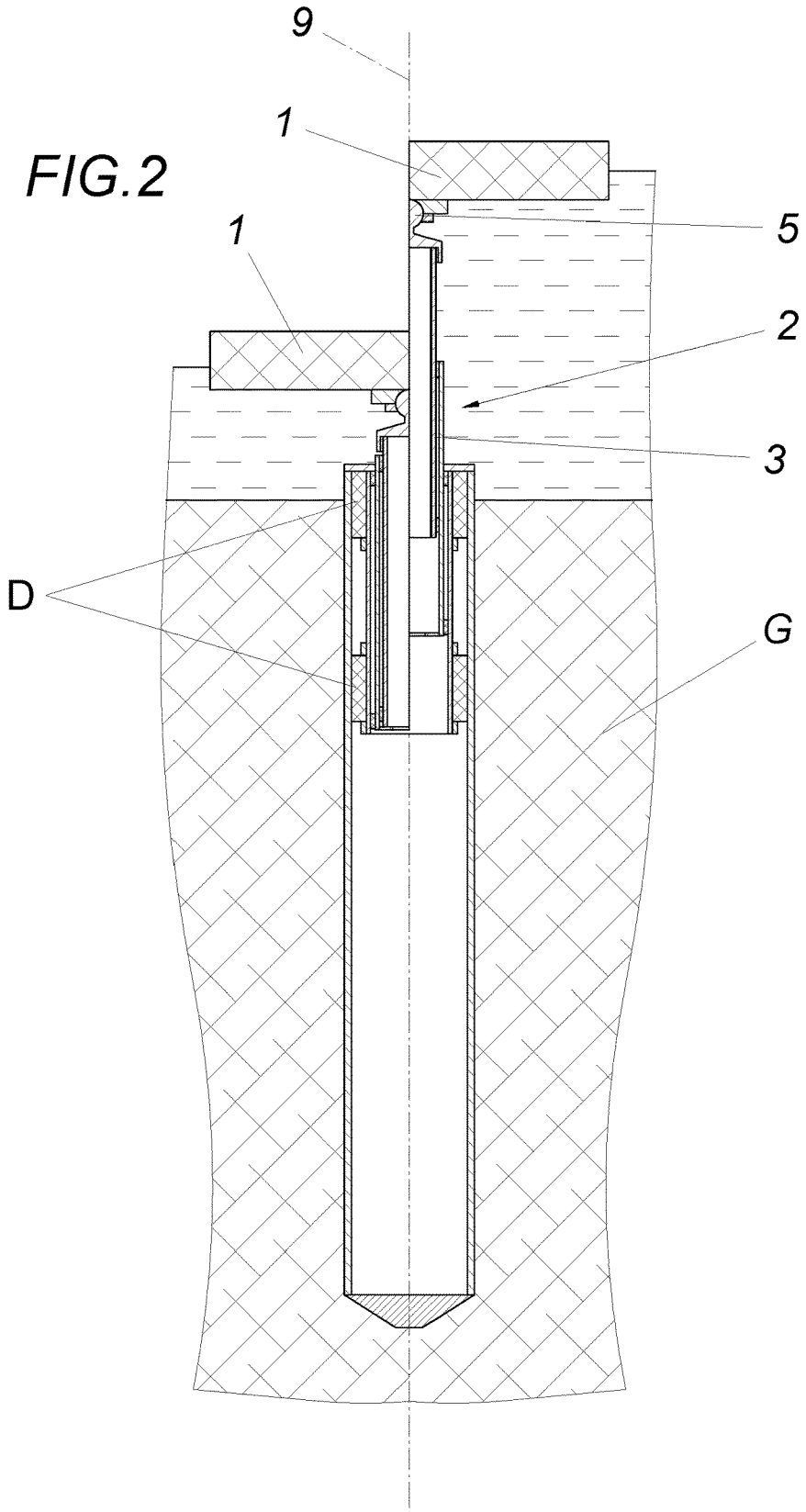
FIG. 2 shows a constructional variant of the device of FIG. 1.

The device according to the invention for fixing floating bodies 1, 1' comprises a pile 2 which can be fixed at one end to the ground G and to which the floating bodies 1, 1' can be fixed in the region of the other end. According to the invention, the pile is designed as a telescopic tube, with which a tidal range T can be compensated in a particularly advantageous manner, and with a vibration damper D damping the telescopic movement. In the embodiment according to FIGS. 1 and 2, the pile is equipped with a floating body 1, in particular a floating jetty, at its end facing away from the ground G. In the embodiment according to FIG. 1, the pile is in this case bolted on the base side to the ground, a rock or a concrete basin, by means of a flange 4. The respective bolted connection is only indicated. In the embodiment according to FIG. 2, the pile 2 is sharpened and driven into the ground G. In addition, the pile 2 in the embodiment according to FIG. 2 is equipped with a ball coupling 5 at one end and in the exemplary embodiment according to FIG. 1 at both ends.

The pile 2 can also be braced by means of pendulum supports 6 or pulling means 7 acting on the pile 2 at one end and on the ground G at the other end. In the embodiment according to FIG. 2, no such means are shown, but these could obviously be provided in this design.

Figure 3:
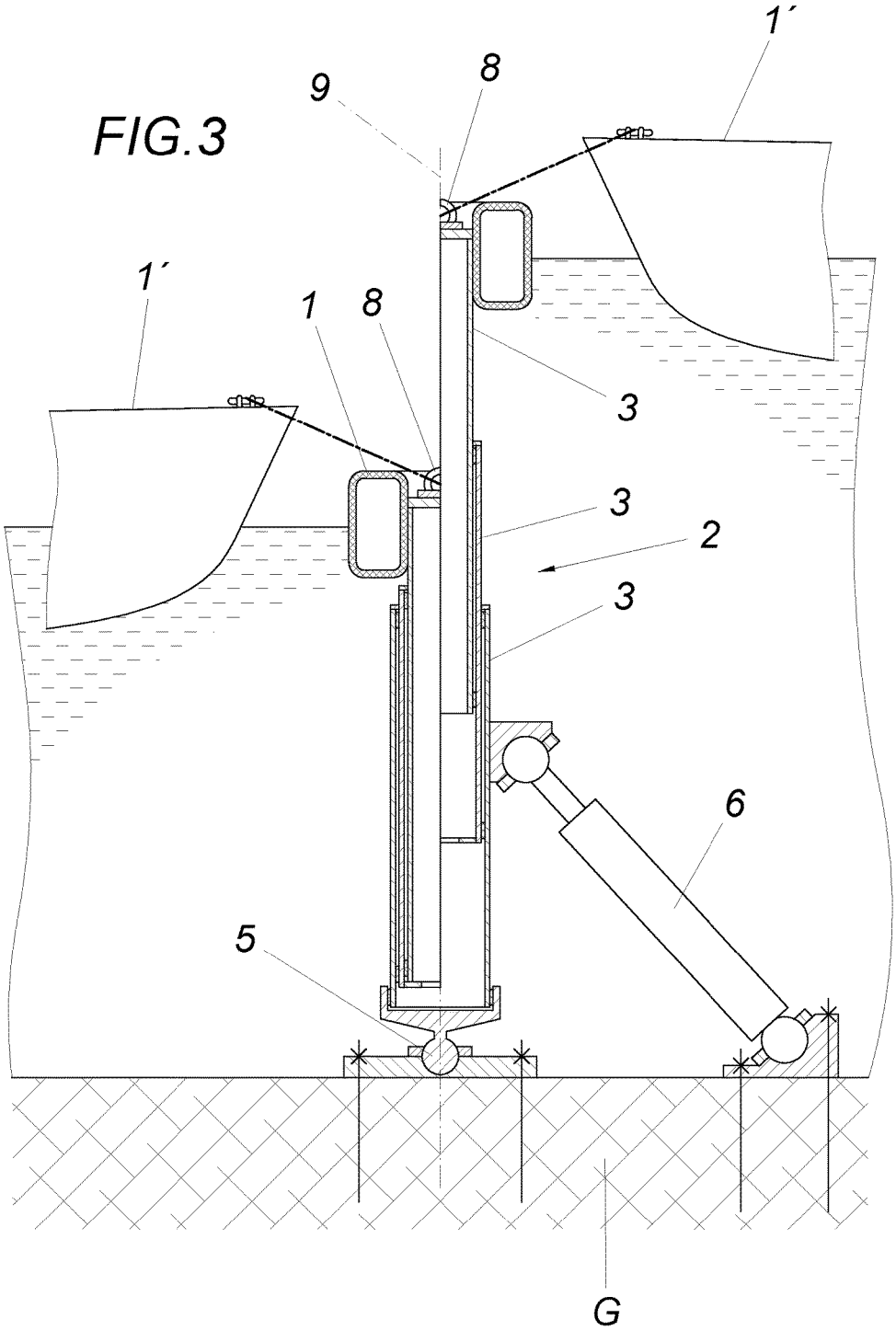
FIG. 3 shows a further constructional variant of the device from FIG. 1 and FIG. 2.
Figure 4:
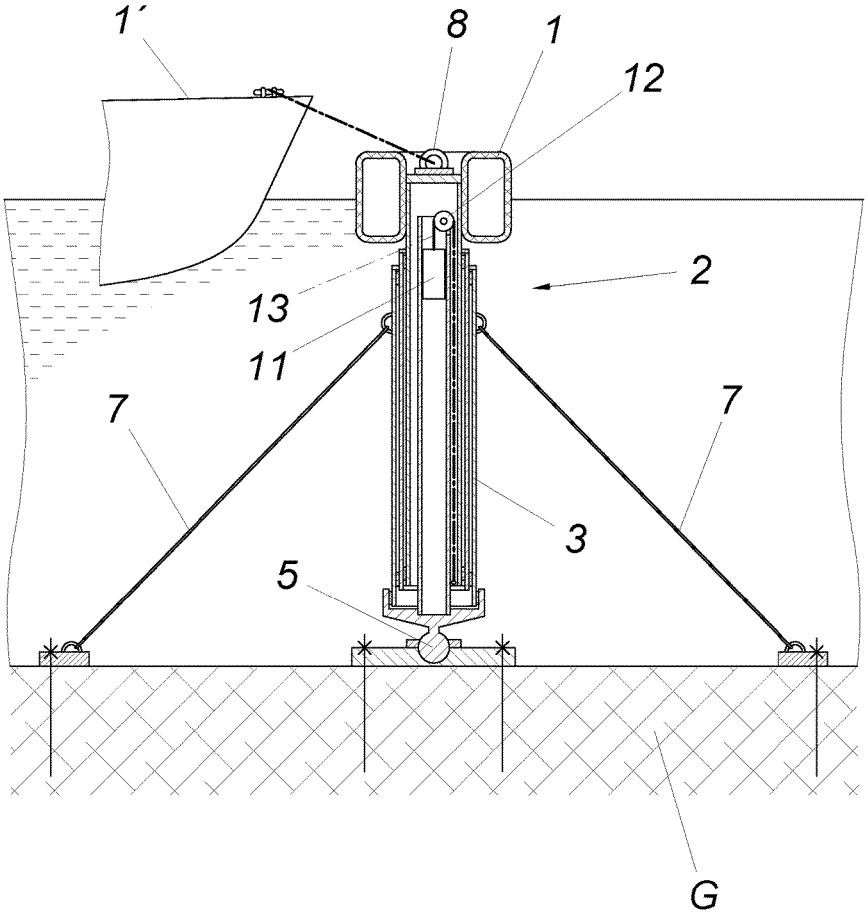
FIG. 4 shows a device with lifting force support in cross-section with retracted telescopic tube.
Figure 5:
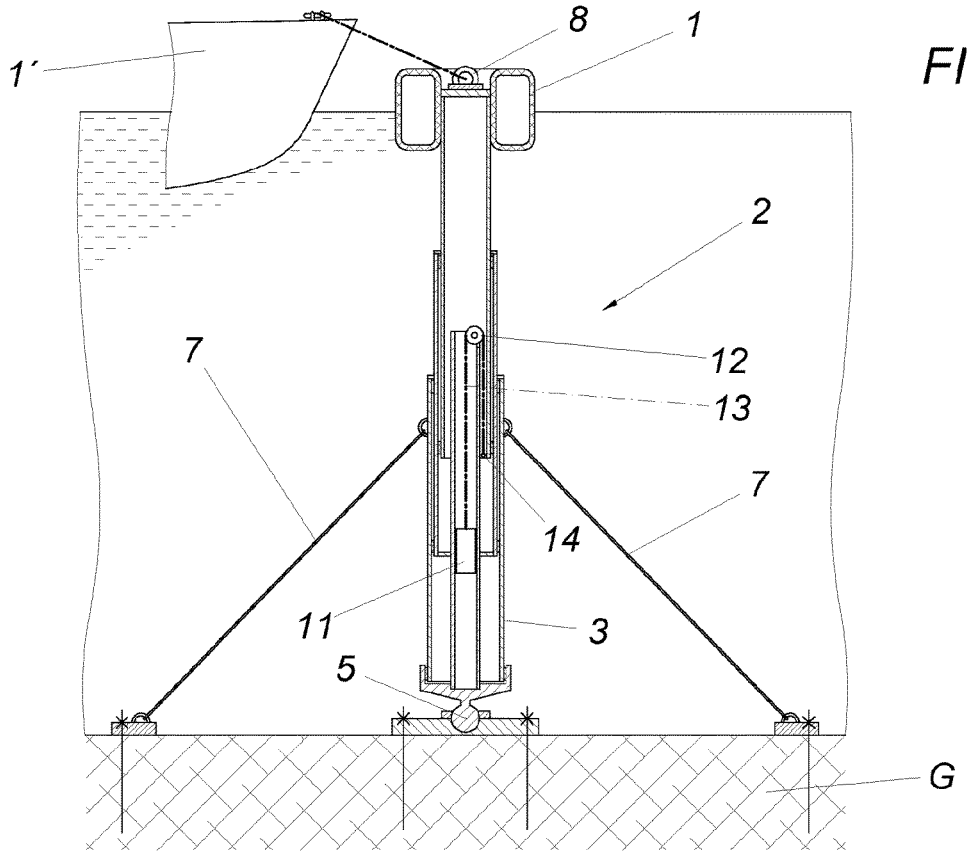
FIG. 5 shows the device of FIG. 4 with the telescopic tube extended.

In the exemplary embodiment according to FIG. 3, the floating body 3 is a buoy, with which the device can be provided, for example, for producing a buoy field. A ship 1' can then usually be attached with the buoy or the pile 2 to a stop means 8. In the embodiment according to FIGS. 4 and 5, the pile is equipped with a lifting force support. The lifting force support acts in the extension direction. This serves to provide weight compensation in relation to a floating jetty resting on the pile. The illustrated lifting force support comprises a counterweight 11 which can be displaced in the interior of the pile 2 and which acts on a partial tube 14 of the telescopic tube of the pile 2 via a pulling means 13 deflected by a deflection roller 12.

The invention claimed is:

1. A device for fixing floating bodies, said device comprising:

a pile configured to be fixed at one end thereof to a ground and in a region of another end thereof configured to be fixed to the floating body, wherein the pile is a telescopic tube, and the pile has a length that adapts automatically to tidal range conditions moving the floating body; and wherein the pile is braced by pendulum supports acting on the pile at one end thereof and on the ground at an opposing end thereof, and the pendulum supports each comprise two telescopically displaceable support parts which can be moved towards each other by a spring device, both in a tensioning direction as well as in a pressure direction, and the pendulum supports are capable of removing tensile and pressure forces in a spring-loaded manner.

2. A device according to claim 1, wherein the pile is equipped with a floating body at the end thereof facing away from the ground.

3. A device according to claim 1, wherein the pile is telescopic along an axis thereof, and is equipped with a vibration damper that dampens the telescopic movement.

4. A device according to claim 1, wherein the pile has a lifting force support acting in an extension direction thereof.

5. A device according to claim 4, wherein the lifting force support comprises a spring provided in an interior of the pile.

6. A device according to claim 5, wherein the spring is a gas pressure spring.

7. A device according to claim 1, wherein the pile is driven into the ground.

8. A device according to claim 7, wherein the pile is pointed at a base thereof.

9. A device according to claim 1, wherein the pile is fixed on base side thereof to the ground by at least one flange.

10. A device according to claim 1, wherein the pile is equipped with a ball coupling and/or a universal joint at least at one of the ends thereof.

11. A device for fixing floating bodies, said device comprising:

a pile configured to be fixed at one end thereof to a ground and in a region of another end thereof configured to be fixed to the floating body, wherein the pile is a telescopic tube, and the pile has a length that adapts automatically to tidal range conditions moving the floating body;

wherein the pile has a lifting force support acting in an extension direction thereof; and wherein the lifting force support comprises a counterweight that can be displaced in the interior of the pile and that acts on a partial tube of the telescopic tube via a pulling structure deflected by a deflection roller.

12. A device for use on ground having water thereon with a depth that varies, as by tidal conditions, said device comprising:

a floating body; and a pile having a first end fixed to the ground and a second end distal to the first end, said second end being connected with the floating body;

wherein the pile includes a telescopic tube structure between the first and second ends thereof, said telescopic tube structure varying in axial length thereof and varying the distance between the first and second ends such that the pile has a length that adapts automatically to changes in the location of the floating body due to the varying depth of the water; and wherein support structures are connected between the ground and a portion of the pile spaced from the first end thereof so as to brace the pile; and wherein the support structures each comprise two telescopically displaceable support parts that are movable relative to each other in a tensioning direction and in a pressure direction with a spring device so that the support structures are configured to remove tensile and pressure forces in a spring-loaded manner.

13. A device according to claim 12, wherein the telescopic tube structure includes a damper that damps variations in the axial length thereof, and a lifting force support applying a force that biases the telescopic tube structure to increase in said axial length and increase the distance between the first and second ends.

14. A device according to claim 13, wherein the lifting force support comprises a spring supported in the telescopic tube structure that applies a force that biases a movable portion of the telescopic tube structure connected with the second end of the pile to move away from the first end of the pile.

15. A device according to claim 13, wherein at least one of the ends of the pile has a connection structure that provides connection with the ground or the floating body with a range of angular orientations.

16. A device according to claim 12, wherein the first end of the pile has a pointed structure that is driven into the ground.

17. A device according to claim 12, wherein the first end of the pile has a base comprising at least one flange that is affixed to the ground.

18. A device for use on ground having water thereon with a depth that varies, as by tidal conditions, said device comprising:

a floating body; and a pile having a first end fixed to the ground and a second end distal to the first end, said second end being connected with the floating body;

wherein the pile includes a telescopic tube structure between the first and second ends thereof, said telescopic tube structure varying in axial length thereof and varying the distance between the first and second ends such that the pile has a length that adapts automatically to changes in the location of the floating body due to the varying depth of the water;

wherein the telescopic tube structure includes a damper that damps variations in the axial length thereof, and a lifting force support applying a force that biases the telescopic tube structure to increase in said axial length and increase the distance between the first and second ends; and wherein the lifting force support comprises a counterweight that is supported for movement inside the telescopic tube structure and that is connected via a roller structure such that downward force of the counterweight biases a movable portion of the telescopic tube structure connected with the second end of the pile to move upward.

* * * * *